United States Patent [19]

Deacon

[11] 4,286,396

[45] Sep. 1, 1981

[54] TRACTION DEVICE FOR WALKING ON ICE

[76] Inventor: Robert H. Deacon, 5054 Laurel Ave., Pennsauken, N.J. 08109

[21] Appl. No.: 103,102

[22] Filed: Dec. 13, 1979

[51] Int. Cl.[3] ..... A43C 15/00; A43B 3/18

[52] U.S. Cl. ..... 36/62; 36/7.7

[58] Field of Search ..... 36/7.6, 7.7, 62

[56] References Cited

U.S. PATENT DOCUMENTS

| | | | |
|---|---|---|---|
| 1,616,790 | 2/1927 | Fish | 36/7.7 |
| 2,401,891 | 6/1946 | Smith | 36/62 |
| 2,579,143 | 12/1951 | Fisher | 36/62 |
| 3,095,657 | 7/1963 | Fradette | 36/7.6 |

FOREIGN PATENT DOCUMENTS

| | | | |
|---|---|---|---|
| 529188 | 10/1954 | Belgium | 36/62 |
| 404465 | 12/1965 | France | 36/62 |

*Primary Examiner*—Patrick D. Lawson

*Attorney, Agent, or Firm*—Morton C. Jacobs

[57] ABSTRACT

A traction device for removable attachment to a user's shoes to assist in walking on ice has a steel plate with depending ice-piercing teeth and an elastic attachment band. The teeth lie in transverse planes and are struck and bent from a flat plate.

3 Claims, 3 Drawing Figures

TRACTION DEVICE FOR WALKING ON ICE

BACKGROUND OF THE INVENTION

This invention relates to a traction device that attaches to a person's shoes to assist in walking on ice.

The device consists of two parts. One part is a metal plate with traction teeth that penetrate the ice and provide the necessary friction when walking thereon. The other is an elastic attachment that fits over a shoe and holds the metal plate in position projecting from the sole of the shoe while walking.

Devices of the type of this invention have been used to provide effective footing when walking on a slippery surface, and particularly on ice. One such device is described in the U.S. Pat. No. 2,366,649.

SUMMARY OF THE INVENTION

An object of this invention is to provide a new and improved shoe attachment for walking on ice, which provides good traction and is easily secured to a person's shoe when coming upon an icy surface and removed after safely traversing the surface.

Another object of the invention is to provide a new and improved shoe attachment for walking on ice which is inexpensive to fabricate and which provides an effective traction to prevent slipping on an effective icy surface.

In accordance with one embodiment of this invention a new and improved shoe attachment for safe walking on ice is provided by means of a metal plate generally rectangular in shape which has means for attaching the plate to the sole of a shoe. The metal plate is formed as an integral member having a generally flat sole-engaging surface. Four triangular teeth are formed each bent from one of the four corners of the plate with a side of the triangle forming the bent edge of the corner and with the opposite vertex projecting away from the sole-engaging surface. Two additional triangular teeth are formed on opposite edges of the plate. Each of these additional teeth are bent at the edge of the plate to form the triangular side of the tooth and the opposite vertex projects away from the sole-engaging surface. These additional teeth lie between and spaced from the corner teeth, and their planes extend transversely to the planes of the corner teeth. In addition, the plate has one or more triangular teeth that are struck from an intermediate portion of the plate; and the planes of these intermediate teeth extends at right angles to the planes of the additional teeth and are generally aligned with the spaces between the additional and corner teeth. Two slots formed in the metal plate extend along the other edges of the rectangular plate and an attaching means such as an elastic band is secured within those slots. Thereby a plurality of triangular traction teeth are formed in these plates which have their points generally in the same plane; the planes of the sides of the teeth extend at different angles to ensure that the teeth tend to so penetrate the ice that the user's shoes do not slide no matter which way the user's weight is projected.

DESCRIPTION OF THE DRAWING

The foregoing and other objects of this invention as well as various features thereof will be more fully understood from the following description when read together with the accompaning drawing, in which.

DETAILED DESCRIPTION

Figure 1:
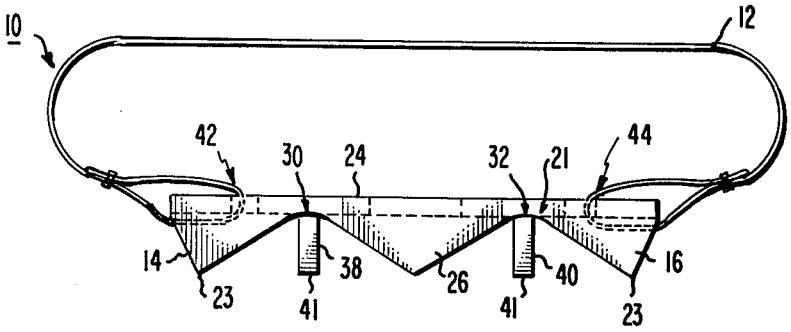
FIG. 1 is a side view of a shoe attachment embodying this invention.

In the drawing, corresponding parts are referenced throughout by similiar numerals.

Figure 2:
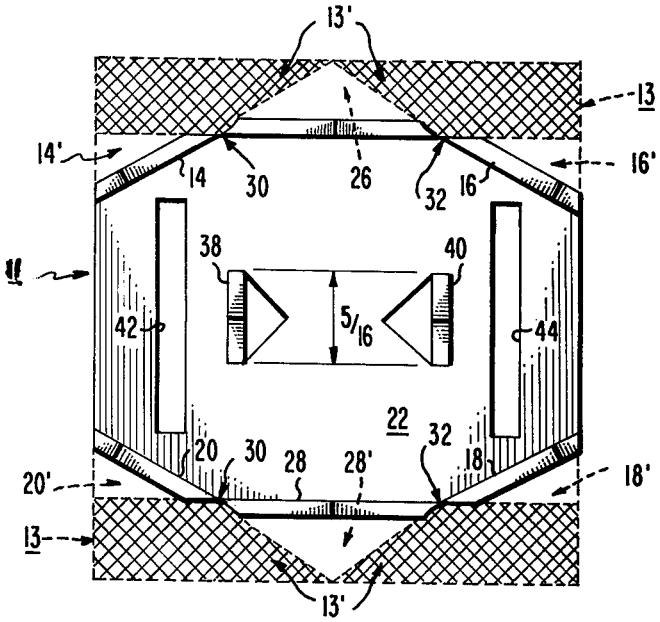
FIG. 2 is a plan view of the underside of the shoe attachment of FIG. 1 with the attachment band removed.
Figure 3:
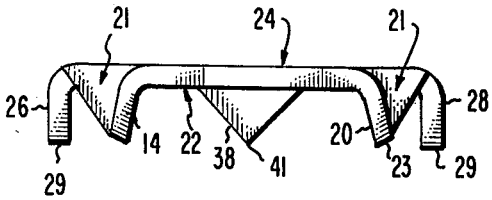
FIG. 3 is an end view of the shoe attachment of FIG. 1 with the attachment band removed.

The shoe attachment 10 in one embodiment of this invention consists of a metal traction plate 11 and an elastic attachment band 12. The plate is fabricated from a generally rectangular flat member 13 of metal, such as cadmium-plated, cold rolled steel. The member 13 before fabrication is shown in broken lines in FIG. 2; cross thatched areas 13 represent portions that are struck and removed in the fabrication process. Bent from the corners are four triangular traction teeth, 14, 16, 18, and 20; the bent edge 21 of these teeth form a side of a triangle with the main planar under surface 22 of the attachment. The opposite vertex 23 of each of these teeth project in a direction away from the top shoe-engaging surface 24 to penetrate the ice. The corner teeth may be bent at any suitable angle; in one form of the invention the planes of the faces of these teeth form an angle of about 30 degrees to the planes of the long (transverse to the direction of walking) sides of the plate 11 was found suitable.

Two additional teeth, 26 and 28, also of the triangular shape are bent from the long edges of the rectangular plate with projecting vertices 29. These teeth, 26 and 28 are bent along the edge of the plate, and their faces have planes that likewise extend along those edges and transversely to the planes of the corner teeth 14–20.

The side teeth, 26 and 28, lie between the associated corner teeth and spaces 30,32 are formed on each side between the side teeth 26,28 and the associated corner teeth 14,16,18, and 20. Aligned with these spaces 30, 30 is an intermediate tooth 38 which is struck from the central plate 22 and likewise projects away from the sole-engaging surface 24. A similar tooth 40 is parallel to tooth 38 and is aligned with the spaces 32, 32 adjacent the other corner teeth 18, 16. The faces of these intermediate teeth 38, 40 have planes that extend at right angles to the planes of the side teeth 26, 28. The vertices 41 of these intermediate teeth lie generally in the same plane as the vertices 23 and 29 of the corner side teeth respectively. Two slots 42, 44 are formed adjacent to the short edges of the rectangular plate, and secured through those slots 42, 44, is an elastic band, the ends of which may be suitably fastened by means of staples 46 or the like.

In fabricating this shoe attachment from a flat steel sheet metal plate 13 of suitable thickness, a single die and stamping operation has been found suitable to reduce the cost. That is, the stock sheet 13 as shown by the dotted lines before fabrication, is in rectangular form, and the corners 14–20 can all be bent in a single operation along with the side teeth 26 and 28. The portion of the plate 13 that is cut away is shown by hatching 13', and the sheet sections before being bent into teeth are shown by the corresponding reference numerals with the addition of a prime, that is, 14', 16–, 18', 20', 26', 28'. Similarly, the slots 42 and 44 are cut out in the same stamping operation as are the intermediate teeth 38 and 40, which are then bent into position.

In use, the elastic band 46 of the shoe attachment is slipped over the user's shoe with plate surface 24 against the sole of the shoe and with the teeth projecting downwardly therefrom; FIG. 1 illustrates the orientation of the device 10 in normal use with the shoe extending through the loop of band 12. The user is then in a position to walk with substantial increase in traction. That is, the vertices of the triangular teeth each tend to penetrate the ice under the weight of the user and the flat faces of the teeth tend to resist any movement at right angles thereto. Thus, the faces of the edge teeth 26, 28 tend to prevent forward and back sliding along the ice along the direction of walking, the faces of the intermediate teeth 38, 40 tend to prevent sideways movement of the user's shoe, and the corner teeth 14, 16, 18, 20 provide traction at an intermediate angle. Thereby the traction is effectively increased in all directions. The device can be easily removed from the shoe when any particular icy surface has been traversed, and re-applied when another stretch of ice must be crossed.

Accordingly, a new and improved shoe attachment for increasing traction in walking on ice is provided. This device is easily used and inexpensive to manufacture.

What is claimed is:

1. A traction device for attachment to shoes to assist in walking on ice, said device comprising:

a metal plate; and means for removably attaching said plate to shoes;

said metal plate being formed as an integral, generally rectangular member and having a generally flat sole-engaging surface, said rectangular plate further having: four triangular portions each bent at one triangle side from a different corner of said plate and with the opposite vertex projecting away from said sole-engaging surface, to form four traction teeth;

two additional triangular traction teeth, one on each of opposite edges of said rectangular plate, each bent at one triangle side from the associated edge of said plate and with the opposite vertex projecting away from said sole-engaging surface;

said additional teeth being between and spaced from said corner teeth of the associated edge and having respective planes extending transversely to the planes of said corner teeth, said corner and additional teeth being fabricatable together in a single die and stamping operation;

at least one other triangular tooth struck from an intermediate portion of said plate remote from the edges thereof and having a plane extending orthogonally to the planes of said additional teeth and transversely to the planes of said corner teeth and aligned with spaces between said additional and corner teeth.

2. A shoe attachment device as recited in claim 1 wherein said rectangular plate further has two slots adjacent to the other two edges thereof and extending therealong; and said attaching means is secured to said slots.

3. A shoe attachment device as recited in claim 2 wherein said attaching means includes an elastic band that fits about the user's shoe.

* * * * *